US006626266B2

(12) United States Patent
Hamaguchi

(10) Patent No.: US 6,626,266 B2
(45) Date of Patent: Sep. 30, 2003

(54) ELEVATOR SYSTEM OCCUPYING REDUCED AREA

(75) Inventor: Syuki Hamaguchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/915,757

(22) Filed: Jul. 27, 2001

(65) Prior Publication Data

US 2002/0040830 A1 Apr. 11, 2002

(30) Foreign Application Priority Data

Sep. 4, 2000 (JP) ..... 2000-267185

(51) Int. Cl.[7] ..... B66B 11/08

(52) U.S. Cl. ..... 187/266; 187/251; 187/254; 254/393

(58) Field of Search ..... 187/251, 254, 187/262, 264, 266, 411; 254/393, 394

(56) References Cited

U.S. PATENT DOCUMENTS

| | | | | | |
|---|---|---|---|---|---|
| 3,519,101 | A | * | 7/1970 | Sieffert | 187/256 |
| 4,013,142 | A | * | 3/1977 | Hagg | 187/254 |
| 4,756,388 | A | * | 7/1988 | Heikkinen | 187/266 |
| 4,807,723 | A | * | 2/1989 | Salmon et al. | 187/266 |
| 4,949,815 | A | * | 8/1990 | Pavoz | 187/266 |
| 5,009,288 | A | * | 4/1991 | Nakai et al. | 187/411 |
| 5,076,398 | A | * | 12/1991 | Heikkinen | 187/266 |
| 5,226,507 | A | * | 7/1993 | Kawarasaki | 187/251 |
| 5,429,211 | A | * | 7/1995 | Aulanko et al. | 187/254 |
| 5,526,901 | A | * | 6/1996 | Salmon | 187/254 |
| 5,566,783 | A | * | 10/1996 | Yamashita | 187/266 |
| 5,788,018 | A | * | 8/1998 | Mendelsohn et al. | 187/266 |
| 6,006,865 | A | * | 12/1999 | Ammon | 187/266 |

FOREIGN PATENT DOCUMENTS

| | | | | |
|---|---|---|---|---|
| GB | 2216486 | * | 10/1989 | 187/266 |
| JP | 2593288 | * | 3/1997 | |
| WO | WO 200224566 | * | 3/2002 | |

* cited by examiner

*Primary Examiner*—Eileen D. Lillis
*Assistant Examiner*—Paul T. Chin
(74) *Attorney, Agent, or Firm*—Leydig, Voit & Mayer, Ltd.

(57) ABSTRACT

An elevator system includes a cage hoisted by a rope; a counter weight hoisted by the rope; a traction machine in the elevator shaft and higher than a cage stopping position at the uppermost floor, having a driving sheave around which the rope is passed, and a motor for driving the driving sheave to move the cage and the counter weight in the elevator shaft in accordance with the driving of the driving sheave; and a deflector wheel with upper and lower ends lower and higher, respectively, than ends of the traction machine, spaced from the traction machine, in plan, and wound partially with the rope, the rope extending upward in the elevator shaft from the counter weight, passing around the deflector wheel and driving sheave, and extending downward to the cage.

15 Claims, 9 Drawing Sheets

ELEVATOR SYSTEM OCCUPYING REDUCED AREA

BACKGROUND OF THE INVENTION

1. Field of the Invention

This invention relates to a machine roomless elevator system not having a machine room.

2. Description of the Related Art

A related art machine-roomless elevator system is disclosed, for example, in Japanese Patent No. 2593288. In this machine-roomless elevator system, a traction machine is provided on a wall surface in an elevator shaft, and a machine room is thereby omitted.

FIG. 8 is a perspective view of a related art machine roomless elevator system disclosed in Japanese Patent No. 2593288, and FIG. 9 a sectioned plan taken from an upper side of the elevator shaft of the elevator system of FIG. 8. Referring to these drawings, a reference numeral 1 denotes an elevator shaft in which a cage 4 to be described later of the elevator system and a counter weight 5 are moved up and down in the direction of the height thereof, 4 the cage of the elevator system, 6 cage guide rails for guiding the vertical movements of the cage 4, 7 counter weight guide rails for guiding the vertical movements of the counter weight 5, and 9 a traction machine provided in a top portion of the interior of the elevator shaft 1. The traction machine 9 includes a driving sheave 10 around which a rope 14 is passed, and a motor 11 for driving the driving sheave 10.

A reference numeral 12 denotes two cage suspending wheels provided on a lower portion of the cage 4, 13 a counter weight suspending wheel provided on an upper portion of the counter weight 5, and 14 a rope passed around the driving sheave 10 of the traction machine 9, and fixed at one end portion thereof to a cage-side rope fastener 15 provided in a top portion of the elevator shaft 1, and at the other end portion thereof to a counter weight-side rope fastener 16 provided in a top portion of the elevator shaft 1. The rope 14 extends between the cage-side rope fastener 15 and traction machine 9, and is passed around the cage suspending wheels 12. The rope 14 extends between the counter weight-side rope fastener 16 and traction machine 9, and is passed around the counter weight suspending wheel 13. Namely, the weight 5 and cage 4 are suspended from the rope 14 via the weight suspending wheel 13 and cage suspending wheels 12 respectively.

In order to easily inspect the condition of the passing of the rope 14 around the driving sheave 10 and the abrasion of a surface of grooves of the driving sheave 10, the traction machine 9 is provided between a passage for the cage 4 and an inner wall surface of the elevator shaft 1 so that the driving sheave 10 and motor 11 face the cage 4 and the wall of the elevator shaft 1 respectively.

The operation of this elevator system will now be described.

When the motor 11 of the traction machine 9 is driven, the driving sheave 10 is rotated, and the rope 14 is moved owing to the traction occurring between the driving sheave 10 and rope 14. In accordance with the movement of the rope 14, the cage suspending wheels 12 and counter weight suspending wheel 13 are moved. The cage 4 and counter weight 5 are moved in the opposite vertical directions.

In the above-described related art elevator system, the traction machine 9 is provided in the section of a top portion of the elevator shaft 1 which is between the passage for the cage 4 and the inner surface of a wall of the elevator shaft 1 so that the driving sheave 10 faces the cage 4. Therefore, it becomes necessary that the dimensions of the traction machine 9 be increased in accordance with an increase in the dimensions of the cage 4. Namely, it becomes necessary that the thickness of the traction machine 9 be increased, and that a large space for housing the traction machine 9 be secured between the cage 4 and the inner surface of the wall of the elevator shaft 1. This necessarily causes a horizontal cross-sectional area of the elevator shaft 1 to be increased.

Since the motor 11 is provided on the side of the inner surface of the wall of the elevator shaft 1, it is difficult to carry out maintenance work and an inspection operation for electric parts constituting the motor 11, or a brake (not shown) provided in the motor 11 so as to be kept away from an oil on the rope 14.

Therefore, the traction machine 9 is preferably provided in an upper portion of the passage for the cage 4 of the elevator system but this prevents the saving of a space from being attained in the upper portion of the elevator shaft 1.

SUMMARY OF THE INVENTION

The present invention has been made in view of the above-mentioned circumstances, and provides an elevator system having a simple system structure with a horizontal cross-sectional area of an elevator shaft not influenced by the dimensions of a traction machine of the elevator system.

The present invention also provides an elevator system capable of carrying out maintenance work and an inspection operation easily, and having a small height of a top portion of the interior of an elevator shaft.

According to an aspect of the present invention, the elevator system has a cage hoisted by a rope; a counter weight hoisted by the rope; a traction machine provided in the portion of the interior of an elevator shaft which is higher than a cage stopping position on the uppermost floor, having a driving sheave around which the rope is passed and a motor for driving the driving sheave, and adapted to move the cage and counter weight in the vertical direction of the elevator shaft in accordance with the driving of the driving sheave; and a deflector wheel provided so that upper and lower ends with respect to the vertical direction of the elevator shaft of the deflector wheel are lower and higher respectively than those of the traction machine, positioned away from the traction machine in plan, and wound partially with the rope, the rope extending upward in the elevator shaft, being passed around the deflector wheel and driving sheave, and thereafter extending downward to the cage.

According to another aspect of the present invention, the elevator system has a cage hoisted by a rope; a counter weight hoisted by the rope; a traction machine provided in the portion of the interior of an elevator shaft which is higher than a cage stopping position on the uppermost floor, having a driving sheave around which the rope is passed and a motor for driving the driving sheave, and adapted to move the cage and counter weight in the vertical direction of the elevator shaft in accordance with the driving of the driving sheave; and a deflector wheel around which the rope is passed, the rope extending upward in the elevator shaft, being passed around an upper arcuate portion of the deflector wheel, a lower arcuate portion of the driving sheave, and thereafter an upper arcuate portion of the driving sheave, and then extending downward in the elevator shaft.

According to still another aspect of the present invention, the elevator system is in accordance with the second-mentioned elevator system, wherein the deflector wheel is provided so that upper and lower ends with respect to the vertical direction of the elevator shaft of the deflector wheel are lower and higher respectively than those of the traction machine; and positioned away from the traction machine in plan.

According to a further aspect of the present invention, the elevator system is in accordance with the first-mentioned or second-mentioned elevator system, wherein the elevator system is further provided with a fixing member on which the traction machine and deflector wheel are provided, the fixing member extending so that upper and lower ends with respect to the vertical direction of the elevator shaft of the fixing member are lower and higher respectively than those of the traction machine or deflector wheel.

According to another aspect of the present invention, the elevator system is in accordance with the fourth-mentioned invention, wherein the fixing member is provided so as to have in plan an inclination with respect to a side wall of the elevator shaft.

According to still another aspect of the present invention, the elevator system is in accordance with the first-mentioned or second-mentioned invention, wherein an axis of rotation of the driving sheave has at least a first angle of inclination with respect to that of the deflector wheel in the horizontal direction, or a second angle of inclination with respect to that of the deflector wheel in the vertical direction.

According to a further aspect of the present invention, the elevator system is in accordance with the sixth-mentioned invention, wherein the first and second angles of inclination have different values.

According to another aspect of the present invention, the elevator system is in accordance with the sixth-mentioned invention, wherein the first and second angles of inclination have the same values.

According to still another aspect of the present invention, the elevator system is in accordance with the first-mentioned or second-mentioned invention, wherein the rope is fixed at one end portion thereof to a first rope fastener provided on the counter weight, and at the other end portion thereof to a second rope fastener provided on the cage.

According to a further aspect of the present invention, the elevator system is in accordance with the first-mentioned or second-mentioned invention, wherein the rope is fixed at one end portion thereof to a first rope fastener provided in an upper portion of the elevator shaft, and at the other end portion thereof to a second rope fastener provided in an upper portion of the elevator shaft, the cage and counter weight having respective suspension wheels, the cage and counter weight being supported in a suspended state respectively on the rope via their respective suspension wheels.

BRIEF DESCRIPTION OF THE DRAWINGS

Preferred embodiments of the present invention will be described in detail with reference to the following figures, wherein.

DESCRIPTION OF THE PREFERRED EMBODIMENTS

Figure 1:
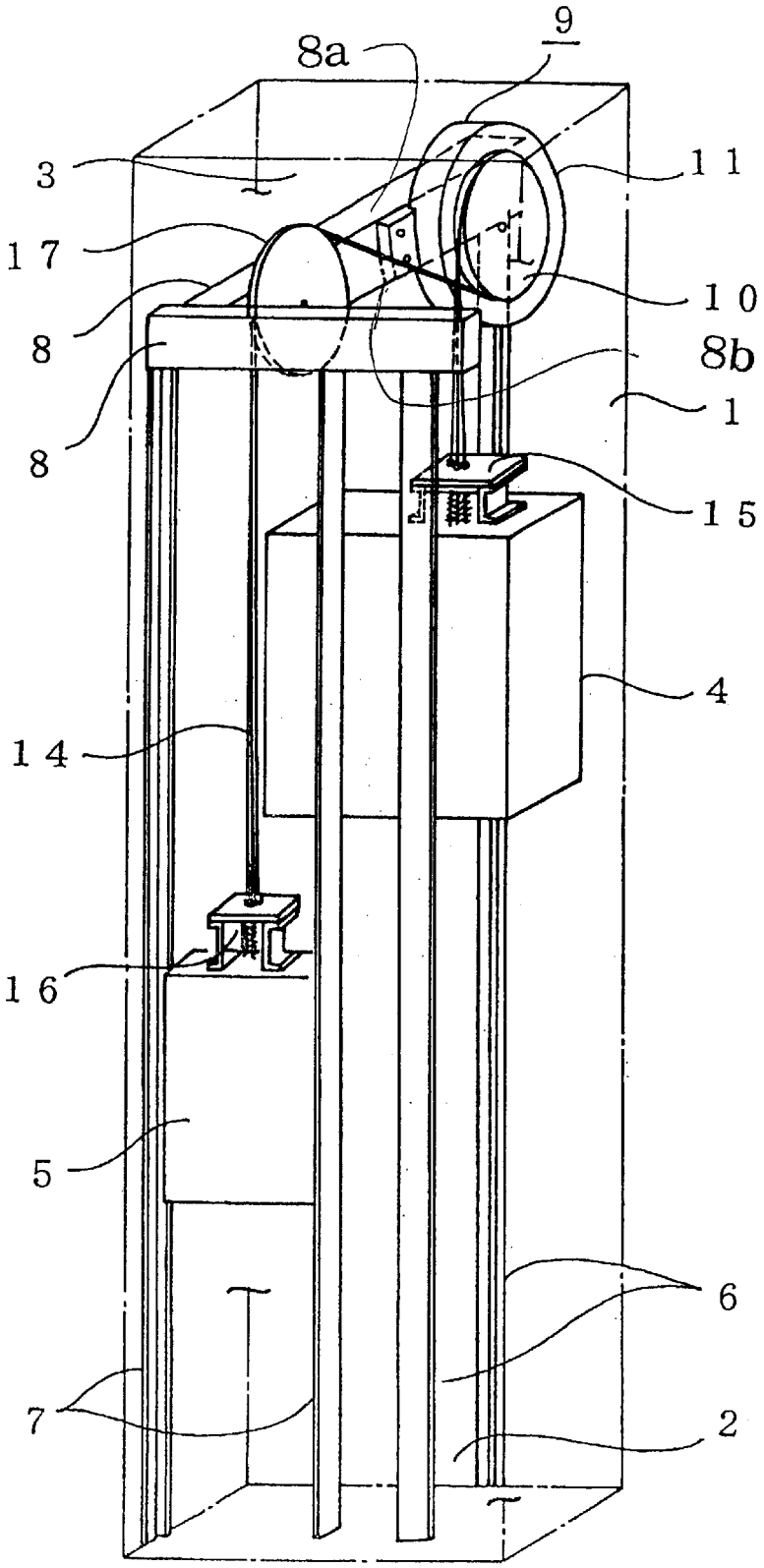
FIG. 1 is a perspective view showing a first embodiment of the elevator system.
Figure 2:
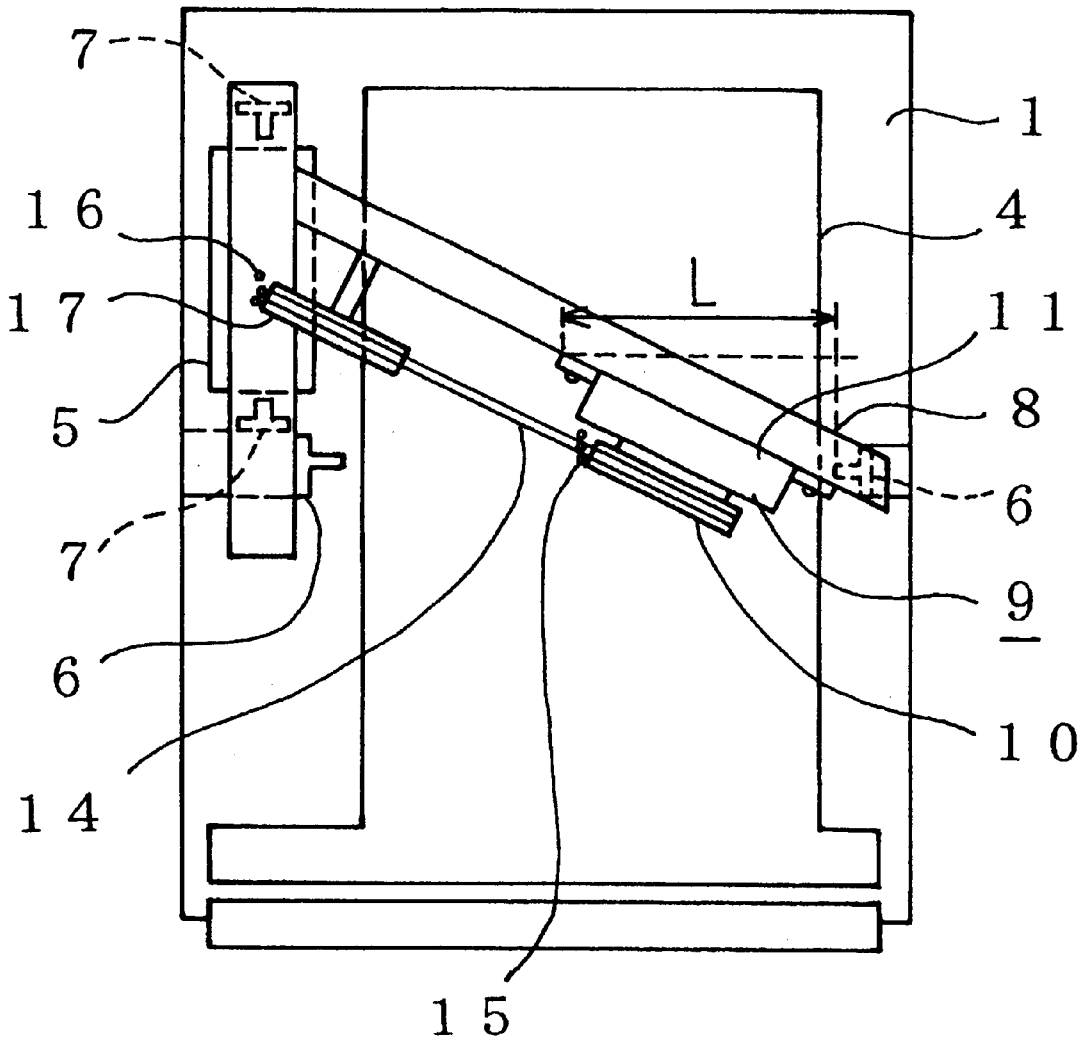
FIG. 2 is a plan view of the elevator system of FIG. 1 taken from an upper side of an elevator shaft.

Mode 1 of Embodiment:

FIG. 1 is a perspective view of the elevator system according to the present invention, and FIG. 2 a plan view of the elevator system of FIG. 1 taken from an upper side of an elevator shaft. Referring to these drawings, a reference numeral 1 denotes an elevator shaft in which a cage 4 and a counter weight 5 which will be described later of the elevator system are moved up and down in the vertical direction, 2 a pit provided in a lower portion of the interior of the elevator shaft 1, 3 a top portion provided in an upper section of the interior of the elevator shaft 1, and 4 a cage of the elevator system hoisted by a rope 14 which will be described later.

A reference numeral 5 denotes a counter weight hoisted by the rope 14 which will be described later, 6 cage guide rails for guiding the vertical movements of the cage 4, 7 weight guide rails for guiding the vertical movements of the counter weight 5, and 8 machine bases as fixing members provided in a top portion 3 of the interior of the elevator shaft 1 for the purpose of fixing a traction machine 9 and a deflector wheel 17, which will be described later, to one of them. The machine bases 8 are beam-like members extending substantially horizontally in the elevator shaft 1, and the traction machine 9 and deflector wheel 17 are fixed to a longer machine base 8 so that the traction machine 9 and deflector wheel are spaced from each other in the lengthwise direction of the longer machine base 8.

A reference numeral 9 denotes a traction machine provided on the longer machine base 8, and formed of a driving sheave 10 around which the rope 14 is passed, and a motor 11 for driving the driving sheave 10.

A reference numeral 14 denotes a rope passed around the driving sheave 10 of the traction machine 9, and fixed at one end portion thereof to a counter weight-side rope fastener 16 provided on an upper portion of the counter weight 5, and at the other end portion thereof to a cage-side rope fastener 15 provided on an upper portion of the cage 4.

A reference numeral 17 denotes a deflector wheel provided on the portion of the longer machine base 8 which are horizontally spaced from the traction machine 9, around which deflector wheel the rope 14 is passed.

Both the traction machine 9 and deflector wheel 17 are provided on the same side surface of the longer machine base 8. The machine bases 8, and traction machine 9 and deflector wheel 17 which are provided on the longer machine base 8, are positioned in the portion of the elevator shaft 1 which is between the cage 4 stopped on the uppermost floor and a ceiling wall of the elevator shaft 1. The traction machine 9, deflector wheel 17 and machine bases 8 are arranged so as to be superposed in plan on the cage 4.

The machine bases 8 have upper and lower surfaces 8*a* and 8*b*, respectively. The upper and lower surfaces 8*a* and 8*b* of a longer one of the machine bases are lower and higher, respectively, than the uppermost extent and the lowermost extent of both of the traction machine 9 and the deflector wheel 17 in the vertical direction of the elevator shaft 1. Namely, the machine bases 8 have a height in the elevator shaft 1 not larger than any of the distance between the uppermost and lowermost extents of the traction machine 9, the distance between the uppermost extent of the traction machine 9 and the lowermost edge of the deflector wheel 17, the distance between the uppermost edge of the deflector wheel 17 and the lowermost extent of the traction machine 9, and the distance between the uppermost and lowermost edges of the deflector wheel 17. In this embodiment, the machine bases 8 are positioned at least as high as the axes of rotation of the fraction machine 9 and deflector wheel 17.

As shown in FIG. 2, the machine bases 8 are provided so that the longer machine base inclines in plan with respect to a side wall of the elevator shaft 1.

A plane in which the deflector wheel 17 rotates is in a perpendicular plane extending in the direction (vertical direction) of the height of the elevator shaft 1, and a plane in which the driving sheave 10 of the traction machine 9 rotates in a substantially perpendicular plane extending in the mentioned direction.

Figure 3:
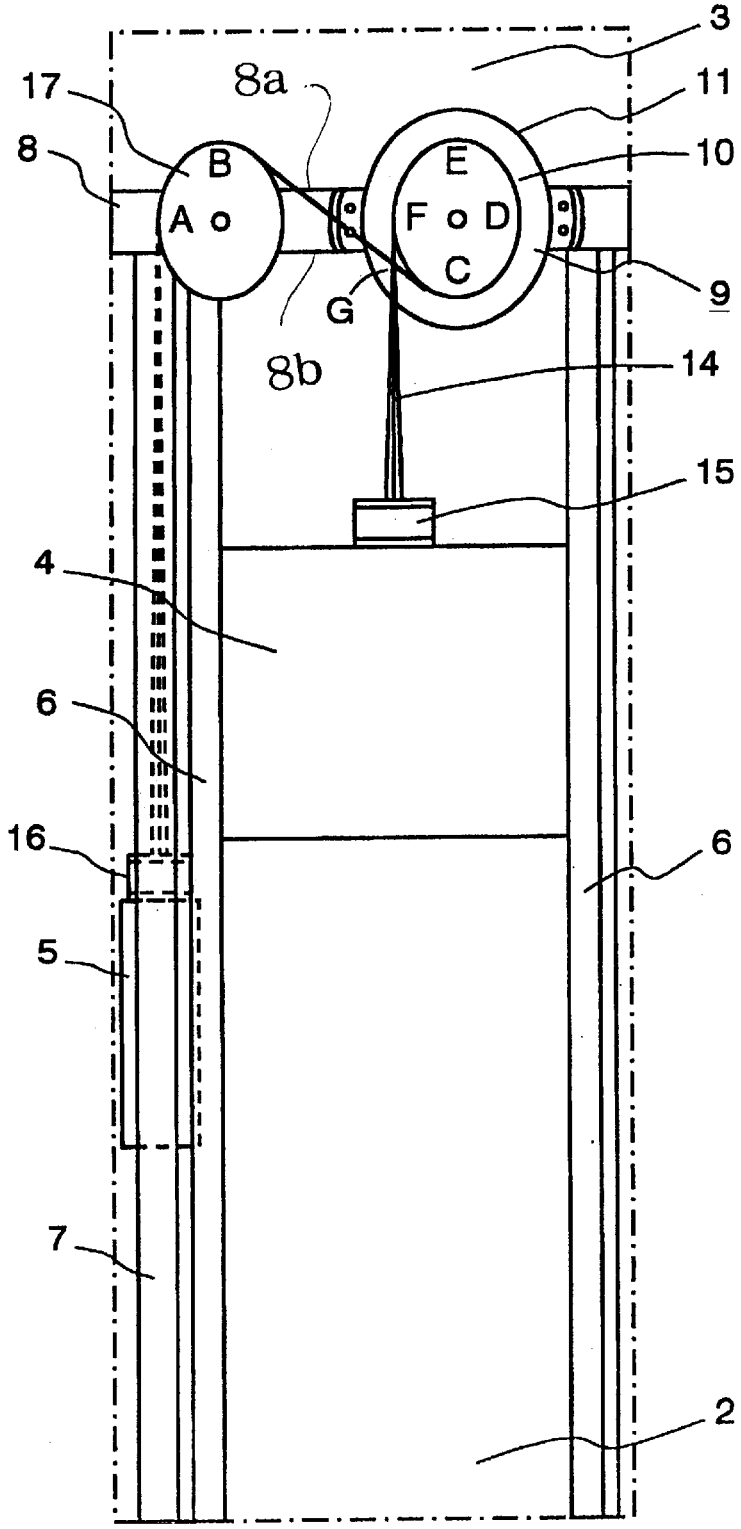
FIG. 3 is a side view the elevator system of FIG. 1.

How to pass the rope 14 around the traction machine 9 and deflector wheel 17 will now be described with reference to FIG. 3.

First, one end portion of the rope 14 is fixed to a counter weight-side rope fastener 16 provided on the upper portion of the counter weight 5.

The rope 14 is then drawn up from the counter weight-side fastener 16 along an inner surface of the elevator shaft 1, and passed around the deflector wheel 17. During this time, the rope 14 starts being passed around the deflector wheel 17 from a side surface A thereof, which is on the opposite side of the traction machine 9, toward an upper end B thereof, i.e., around an upper arcuate portion of the deflector wheel 17. The rope 14 thereafter extends to the driving sheave 10 of the traction machine 9.

The rope 14 is then passed around the driving sheave 10 of the traction machine 9. During this time, the rope 14 extending from the deflector wheel 17 starts being passed around the driving sheave 10 from a lower portion thereof, and then toward a lower end C, a side surface D which is on the opposite side of the deflector wheel 17, an upper end E and a side surface F opposed to the deflector wheel 17. Namely, the rope 14 is passed around the driving sheave 10 from a lower arcuate portion thereof to an upper arcuate portion thereof. The rope 14 then extend downward in the elevator shaft 1 to the cage 4.

Finally, the rope 14 extending downward from the driving sheave 10 is fixed to the cage-side rope fastener 15 provided on the upper portion of the cage 4 of the elevator system.

When the rope 14 is passed around the driving sheave 10, the portion thereof which extends from the deflector wheel 17 to the driving sheave 10, and the portion thereof which extends from the driving sheave 10 to the cage 4 of the elevator system cross each other at an intersection point G. However, the crossing portions of the rope 14 are arranged so as not to interfere with each other. The details of the matter will be described later.

When the rope 14 is passed around the driving sheave 10, it extends via at least a lower end C of the driving sheave 10, the side surface D thereof which is on the opposite side of the deflector wheel 17, an upper end E thereof, and the side surface F thereof which is opposed to the deflector wheel 17. Therefore, a winding angle of the rope 14 is larger than 270° and smaller than 360°.

The positional relation between the deflector wheel 17 and driving sheave 10, and the prevention of the interference of crossing portions of the rope 14 with each other at the intersection point G will now be described in detail with reference to FIGS. 4 and 5.

Figure 4:
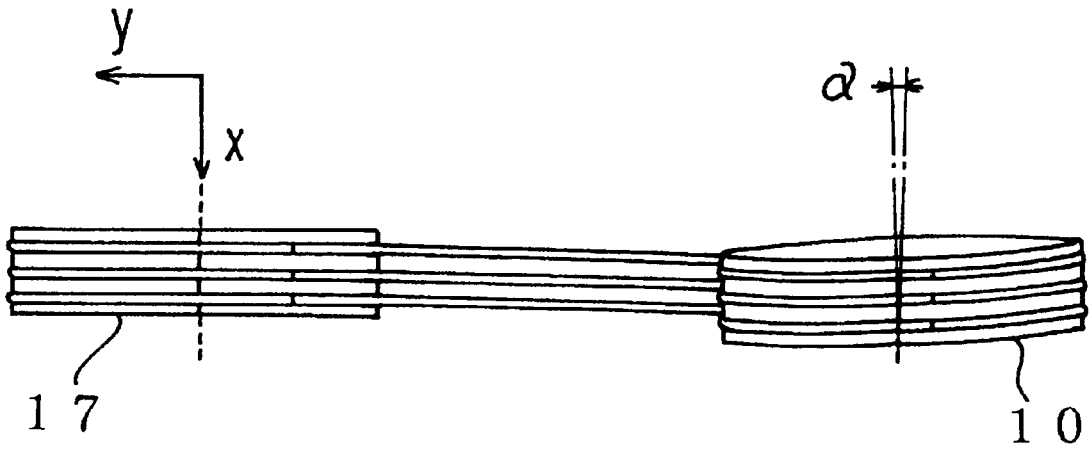
FIG. 4 is a plan view showing the positional relation between a deflector wheel and a driving sheave.
Figure 5:
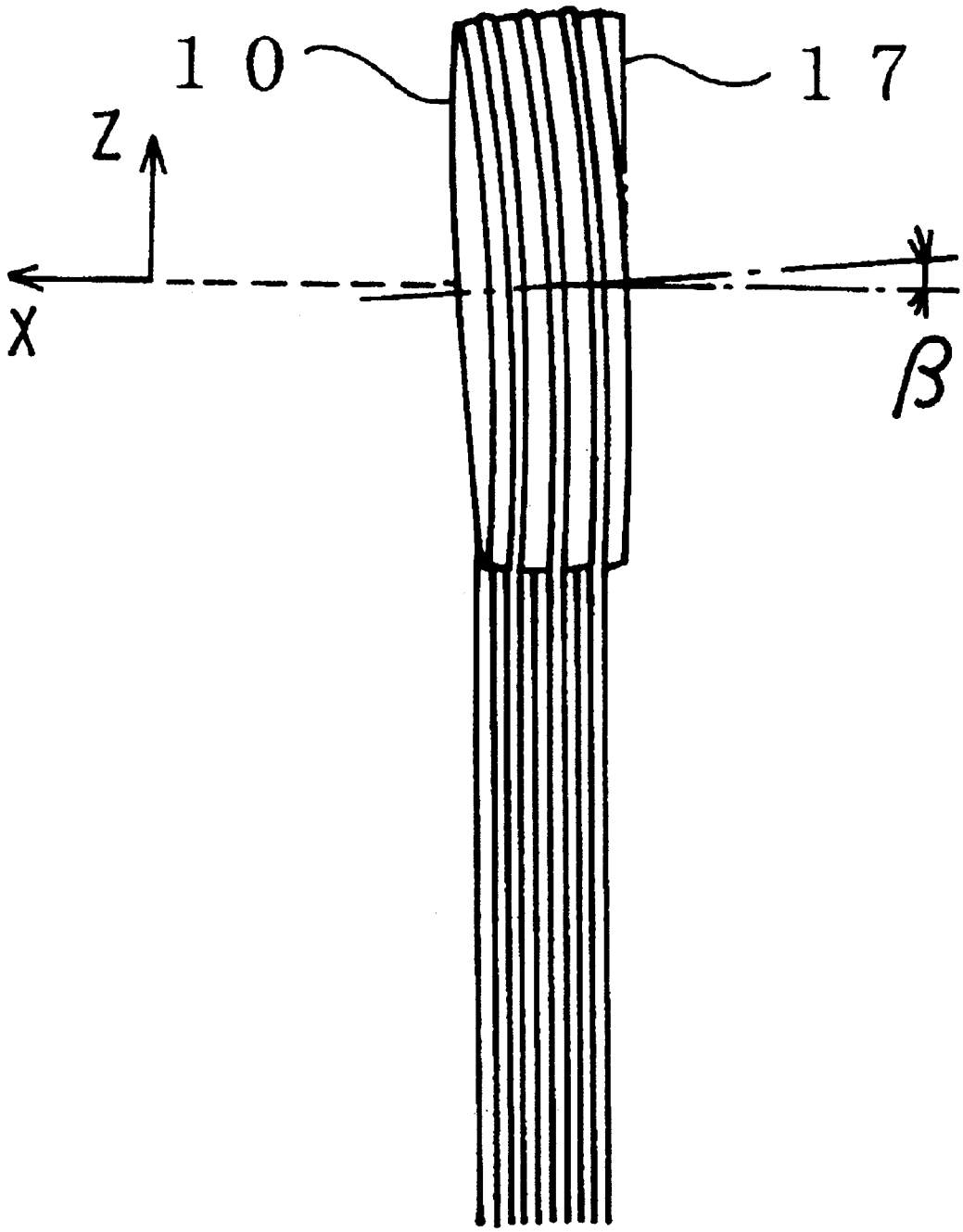
FIG. 5 is a side view showing the positional relation between the deflector wheel and driving sheave.

FIG. 4 is a plan view showing the positional relation between the deflector wheel 17 and driving sheave 10 shown in FIG. 1, and FIG. 5 a side view showing the positional relation between the deflector wheel 17 and driving sheave 10 shown in FIG. 1. For the convenience of the description of the positional relation of these parts, an orthogonal coordinate system of x-axis, y-axis and z-axis is used in each of FIGS. 4 and 5. The x-axis shall represent the direction of the axis of rotation of the deflector wheel 17, y-axis the horizontal direction, and the z-axis the vertical direction.

First, in the horizontal direction (y-axis), the axis of rotation of the driving sheave 10 has a first angle $\alpha$ of inclination with respect to the axis of rotation (x-axis) of the deflector wheel 17.

Next, in the vertical direction (z-axis), the axis of rotation of the driving sheave 10 has a second angle $\beta$ of inclination with respect to the axis of rotation (x-axis) of the deflector wheel 17.

Namely, since the axis of rotation of the driving sheave 10 has first and second angles $\alpha$, $\beta$ of inclination with respect to the axis of rotation of the deflector wheel 17, plural portions of the rope 14 cross each other alternately at the intersection point G, and the interference of these portions of the rope 14 with each other at the same point G is prevented.

Since the first and second angles $\alpha$, $\beta$ of inclination constitute the conditions for preventing portions of the rope 14 from interfering with each other, they vary with the elevator system installation conditions. In a usual case, the second angle $\beta$ is set larger than the first angle $\alpha$.

The first and second angles $\alpha$, $\beta$ have the same values in some cases depending upon the elevator system installation conditions.

The elevator system may have only one of the first angle $\alpha$ of inclination and the second angle $\beta$ of inclination.

The operation of this embodiment will now be described.

When the motor 11 of the traction machine 9 is driven, the driving sheave 10 is rotated, and the rope 14 is moved owing to traction occurring between the driving sheave 10 and rope 14. In accordance with the movement of the rope 14, the cage 4 and counter weight 5 are moved in the opposite vertical directions.

In the elevator system in this mode of embodiment, the traction machine 9 is thus provided on the longer machine base 8 positioned in the top portion 3 of the interior of the elevator shaft 1. Accordingly, even when the sizes of the traction machine 9 are changed due to a change in the capacity of the cage 4, for example, even when the thickness of the traction machine 9 is increased, the increased portion of the traction machine 9 is housed on a plane the area of which is equal to the cross-sectional area of the top portion 3 of the interior of the elevator shaft 1. Therefore, it is unnecessary to increase the sizes of a horizontal cross section of the elevator shaft 1 as a whole.

The rope 14 is passed around the driving sheave 10 of the traction machine 9 so that the rope portion passed around the sheave 10 cross the rope portion passed around the deflector wheel 17, and the axis of rotation of the driving sheave 10 has an angle of inclination with respect to that of the deflector wheel 17. Therefore, the interference of the rope portions with each other can be prevented. This enables the deflector wheel 17 to be positioned away from the traction machine 9 in the horizontal direction.

The longer machine base 8 or the deflector wheel 17 has a height in the elevator shaft 1 does not exceed the height, in the elevator shaft 1, of the traction machine 9. This relationship keeps the height of the elevator shaft 1 to between the cage 4, stopped at the uppermost floor, and the ceiling of the elevator shaft short. Moreover, the elevator system ensures that a predetermined level of traction is achieved.

It also becomes unnecessary to draw round the rope 14 between the cage 4 and corresponding portions of the walls of the elevator shaft 1, so that the elevator system can be formed to a space-saving structure.

Furthermore, since a 1:1 roping method is employed, the number of parts can be reduced, and the system construction can be simplified.

Since the traction machine 9 is provided in a central section in plan of the top portion 3 of the interior of the elevator shaft 1, the simplicity of the maintenance work for and the inspection of the electric parts constituting the motor 11, or a brake (not shown) provided on the motor 11 so as to be kept away from the oil on the rope 14 can be secured as the simplicity of the inspection of the condition of the rope 14 passed around the driving sheave 10 and the abrasion of the surfaces of the grooves of the driving sheave 10 is maintained.

Since the longer machine base 8 is provided so as to incline with respect to side walls of the elevator shaft 1, the traction machine 9 is provided so as to incline necessarily and similarly with respect to the side walls of the elevator shaft 1. Therefore, a system construction in which the suspension points of the cage 4 and counter weight 5 are connected together at the shortest distance can be provided.

Since the longer machine base 8 is provided so as to incline with respect to side walls of the elevator shaft 1, a large traction machine 9 can be used for even a cage 4 having a narrow frontage and a deep depth. The reason is that, when the longer machine base 8 is set at right angles to the side walls of the elevator shaft 1, the width of the traction machine 9 becomes L as shown in FIG. 2.

Mode 2 of Embodiment:

In this mode of embodiment, the parts designated by reference numerals identical with those in the mode 1 of embodiment represent the same or equivalent parts.

Figure 6:
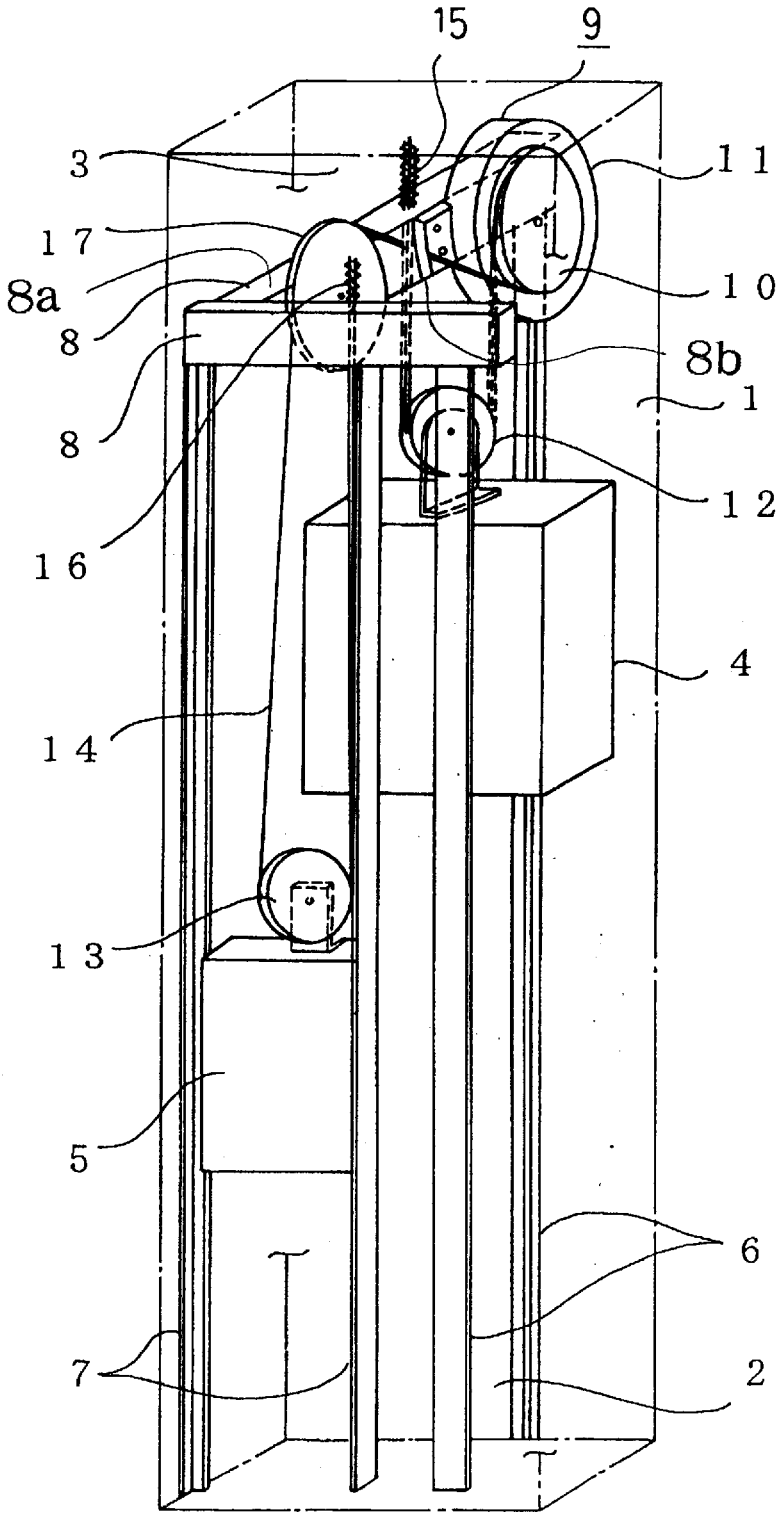
FIG. 6 is a perspective view showing a second mode of embodiment of the elevator system.
Figure 7:
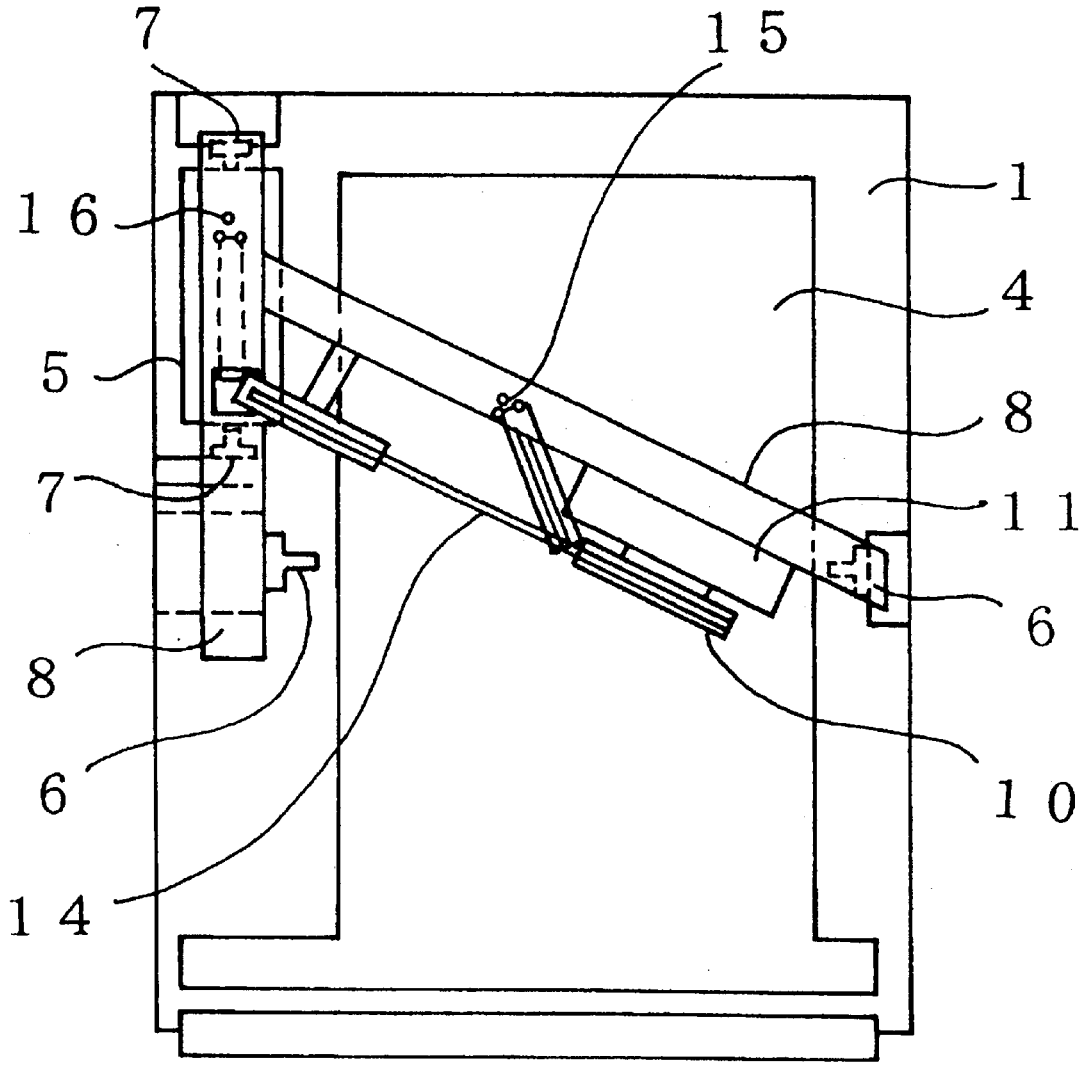
FIG. 7 is a plan view of a second embodiment of the elevator system taken from an upper side of an elevator shaft.
Figure 8:
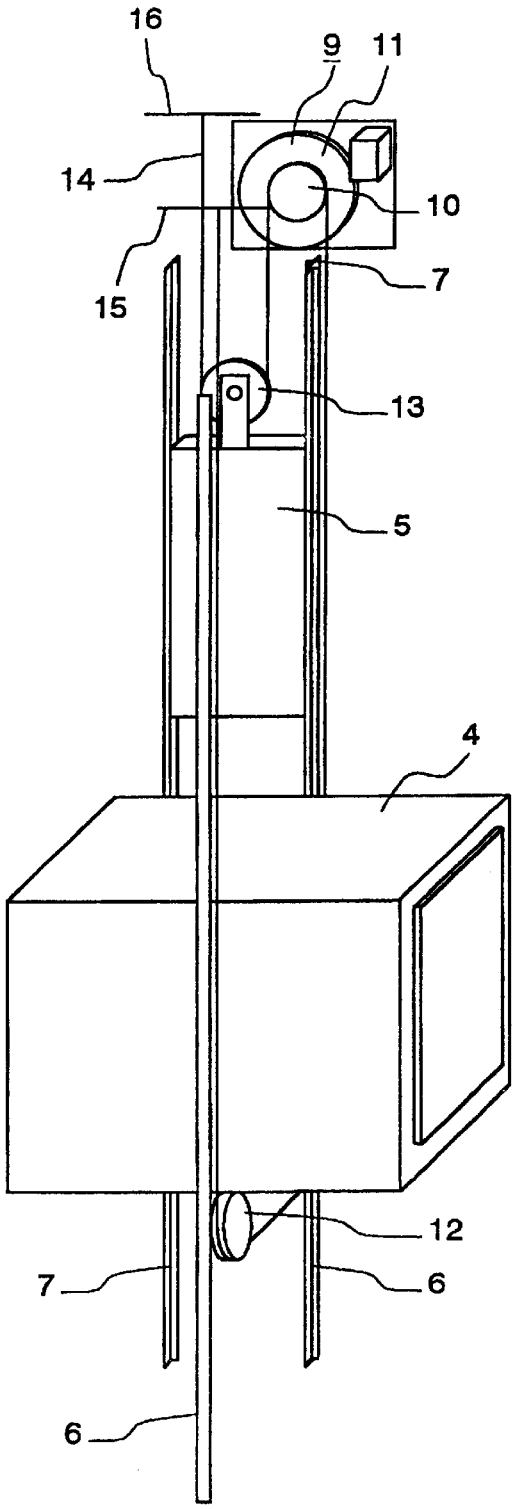
Fig.8 PRIOR ART
FIG. 8 is a perspective view showing a related art elevator system.
Figure 9:
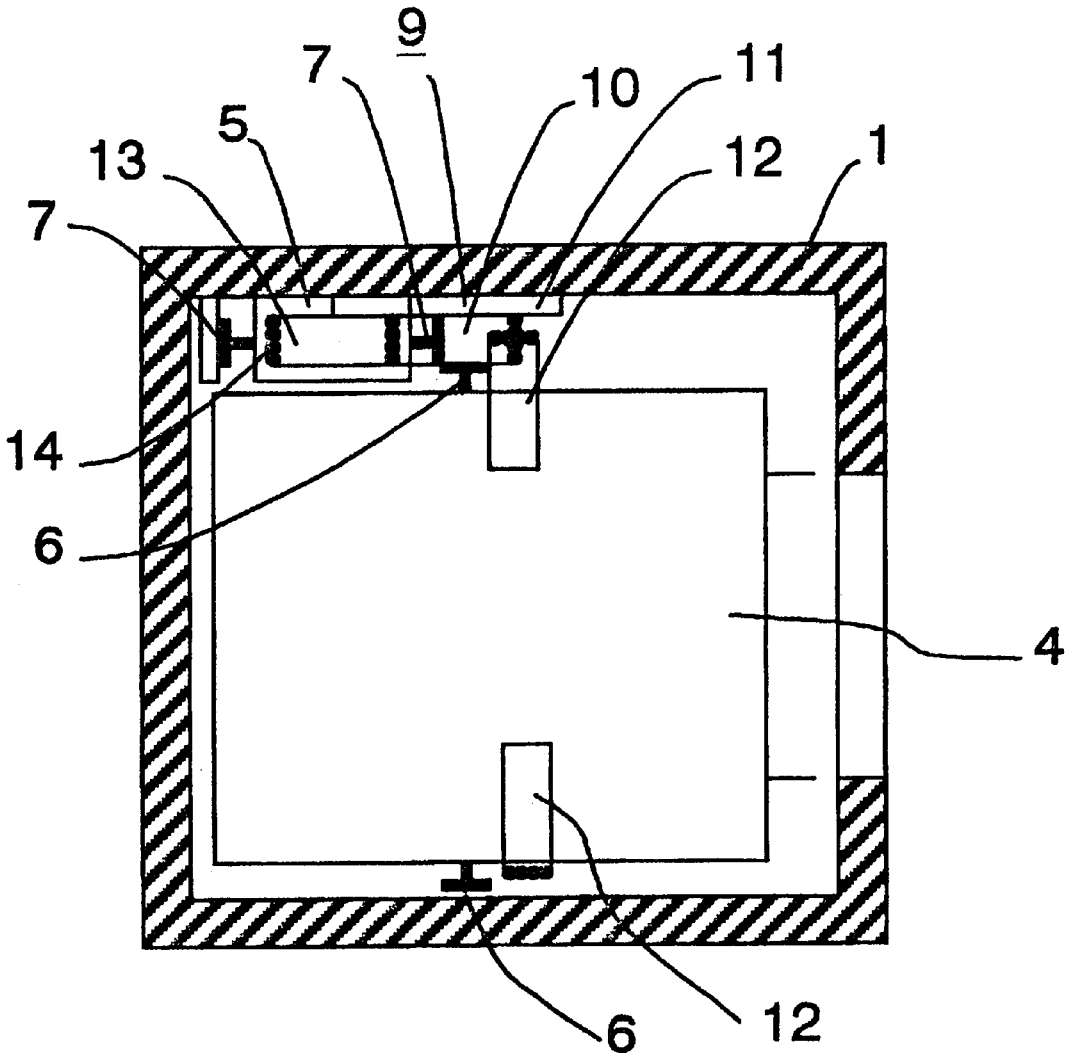
Fig.9 PRIOR ART
FIG. 9 is a plan view of the related art elevator system taken from an upper side of an elevator shaft.

FIG. 6 is a perspective view showing the mode 2 of embodiment of the elevator system, and FIG. 7 a plan view of the mode 2 of embodiment of the elevator system taken from a position above an elevator shaft. Referring to these drawings, a reference numeral 12 denotes a cage suspending wheel provided on an upper portion of a cage 4 of the elevator system, 13 a counter weight suspending wheel provided on an upper portion of a counter weight 5, 14 a rope passed around a driving sheave 10 of a traction machine 9, and fixed at one end portion thereof to a cage-side rope fastener 15, which will be described later, of a top portion 3 of the interior of an elevator shaft 1, and at the other end portion thereof to a weight-side rope fastener 16 in the top portion 3 in the interior of the elevator shaft 1, 15 a cage-side rope fastener provided in the top portion 3 of the interior of the elevator shaft 1, for example, on a longer machine base 8, and adapted to fix the first-mentioned end portion of the rope 14 thereto, and 16 a weight-side rope fastener provided in the top portion 3 of the interior of the elevator shaft 1, for example, on the longer machine base 8, and adapted to fix the second-mentioned end portion of the rope 14 thereto.

The rope 14 extends from the counter weight-side fastener 16 toward a lower portion of the interior of the elevator shaft 1, suspends the counter weight suspending wheel 13, extends toward an upper portion of the interior of the elevator shaft 1, and is passed around a deflector wheel 17. The rope 14 is then passed around the driving sheave 10 of the traction machine 9, extends toward a lower portion of the interior of the elevator shaft 1, suspends the cage suspending wheel 12, extends toward an upper portion of the interior of the elevator shaft 1, and is then fixed to the cage-side rope fastener 15 on the machine base 8.

A method in this embodiment of passing the rope 14 around the deflector wheel 17 and driving sheave 10 is completely identical with that in the mode 1 of embodiment.

The longer machine base 8 may not be provided on cage guide rails 6 and counter weight guide rails 7, i.e., it may be fixed directly to walls of the elevator shaft 1.

Although a statement that the cage-side rope fastener 15 and weight-side rope fastener 16 are provided on the machine bases 8 was made, they may have only to be provided in the top portion 3 of the interior of the elevator shaft 1. These fasteners may be provided without trouble, for example, on a side wall and a ceiling wall of the elevator shaft 1.

The operation of this embodiment will now be described.

When the motor 11 of the traction machine 9 is driven, the driving sheave 10 is rotated, and the rope 14 is moved owing to traction occurring between the driving sheave 10 and rope 14. In accordance with the movement of the rope 14, the cage suspending wheel 12 and counter weight suspending wheel 13 are turned to cause the cage 4 and counter weight 5 to be moved in the opposite vertical directions.

Instead of the cage suspending wheel 12 provided on an upper portion of the cage 4, two cage suspending wheels may be provided on a lower portion of the cage 4. Namely, this embodiment can also be applied to a underslung elevator (not shown) in which a cage 4 is hoisted via a rope 14 using the two cage suspending wheels.

Since the machine roomless elevator system in this mode of embodiment has the above-described construction, the effect identical with that of the mode 1 of embodiment can be obtained.

Moreover, in the mode 2 of embodiment, a 2:1 roping method is employed, and this enables the traction machine 9 to be miniaturized, and an upper space of the interior of the elevator shaft 1 to be formed to a narrower structure.

In each of the modes of embodiment, a structure in which the cage 4 and counter weight 5 are interchanged with each other may be employed. Namely, a structure in which the rope 14 extending from the cage 4 in the upward direction in the elevator shaft 1 is passed around the deflector wheel 17 and then around the driving sheave 10 with the rope 14 thereafter extending downward in the elevator shaft 1 toward the counter weight 5 may be employed without trouble. In this case, a method in use of passing the rope 14 around the driving sheave 10 and deflector wheel 17 is identical with that used in each of the modes of embodiment.

The elevator system according to the present invention is provided with a cage hoisted by a rope; a counter weight hoisted by the rope; a traction machine provided in the portion of the interior of an elevator shaft which is higher than a cage stopping position on the uppermost floor, having a driving sheave around which the rope is passed and a motor for driving the driving sheave, and adapted to move the cage and counter weight in the vertical direction of the elevator shaft in accordance with the driving of the driving sheave; and a deflector wheel provided so that upper and lower ends with respect to the vertical direction of the elevator shaft of the deflector wheel are lower and higher respectively than those of the traction machine, positioned away from the traction machine in plan, and wound partially with the rope, the rope extending upward in the elevator shaft from the counter weight, being passed around the deflector wheel and driving sheave, and thereafter extending downward to the cage. Therefore, when the thickness of the traction machine is increased so as to deal with a change in the sizes of the traction machine, it becomes possible to house the traction machine within a horizontal plane in the top portion of the interior of the elevator shaft, and reduce the height of the same top portion, i.e. a distance between the cage stopped on the uppermost floor and the ceiling wall of the elevator shaft.

The elevator system according to the present invention is provided with a cage hoisted by a rope; a counter weight hoisted by the rope; a traction machine provided in the portion of the interior of an elevator shaft which is higher than a cage stopping position on the uppermost floor, having a driving sheave around which the rope is passed and a motor for driving the driving sheave, and adapted to move the cage and counter weight in the vertical direction of the elevator shaft in accordance with the driving of the driving sheave; and a deflector wheel around which the rope is passed, the rope extending upward in the interior of the elevator shaft, being passed around an upper arcuate portion of the deflector wheel, extending toward a lower arcuate portion of the driving sheave, being passed around the lower arcuate portion of the driving sheave and then an upper arcuate portion thereof and thereafter extending downward in the interior of the elevator shaft. Therefore, even when the sizes of the traction machine are changed, the resultant traction machine can be housed within a horizontal cross section of the top portion of the interior of the elevator shaft, and a predetermined level of traction can be secured.

The deflector wheel is provided so that the upper and lower ends thereof with respect to the vertical direction of the elevator shaft are lower and higher respectively than those of the traction machine, and positioned away from the traction machine in plan. This enables the height of the top portion of the interior of the elevator shaft to be set smaller, i.e., a distance between the cage stopped on the uppermost floor and the ceiling wall of the elevator shaft to be set shorter.

Fixing members to which the traction machine and deflector wheel are attached are provided so that the upper and lower ends with respect to the direction of the height of the elevator shaft of a longer fixing member are lower and higher respectively than those of the traction machine or deflector wheel. This enables the height of the top portion of the interior of the elevator shaft to be set smaller, i.e., a distance between the cage stopped on the uppermost floor and the ceiling wall of the elevator shaft to be set shorter.

Since the fixing members are provided so that a longer fixing member inclines in plan with respect to side walls of the elevator shaft, a simple structure in which the suspension points of the cage and counter weight are connected at the shortest distance is formed. Moreover, a large traction machine can be used for even a large cage having a narrow frontage and a deep depth.

Since the axis of rotation of the driving sheave has at least in the horizontal direction a first angle of inclination with respect to that of the deflector wheel, or in the vertical direction a second angle of inclination with respect to the axis of rotation of the deflector wheel, the interference of rope portions with each other can be prevented.

Since the first and second angles of inclination have different values, the interference of rope portions with each other can be prevented more effectively.

Since the first and second angles of inclination have the same values, the interference of rope portions with each other can be prevented more effectively.

The rope is fixed at one end portion thereof to the first rope fastener provided on the counter weight, and at the other end portion thereof to the second rope fastener provided on the cage. Therefore, it becomes unnecessary to draw round the rope between the cage 4 and the inner surfaces of the walls of the elevator shaft 1.

The rope is fixed at one end portion thereof to the first rope fastener provided in the upper portion of the interior of the elevator shaft, and at the other end portion thereof to the second rope fastener provided in the upper portion of the interior of the elevator shaft. The cage and counter weight have suspension wheels respectively, and are supported in a suspended state via the respective suspension wheels. This enables the traction machine to be miniaturized.

What is claimed is:

1. An elevator system comprising:

a cage hoisted in an elevator shaft by a rope;

a counter weight hoisted by the rope;

a traction machine having an uppermost extent and a lowermost extent with respect to vertical movement of the cage in the elevator shaft, located in the elevator shaft at a position higher than a cage stopping position at an uppermost floor of travel of the cage, having a driving sheave rotating around an axis and around which the rope is passed, and a motor for driving the driving sheave to move the cage and counter weight vertically in the elevator shaft; and a deflector wheel rotating about an axis and having upper edge and a lower edge, with respect to vertical movement of the cage in the elevator shaft, wherein the upper edge of the deflector wheel is lower in the elevator shaft than the uppermost extent of the traction machine, the lower edge of the deflector wheel is higher than the lowermost extent of the traction machine in the elevator shaft, the deflector wheel is spaced from the traction machine in a plan view of the elevator shaft, the rope extends upward in the elevator shaft, passes partially around the deflector wheel and the driving sheave, and, thereafter, extends downward in the elevator shaft to the cage, and the axis of rotation of the driving sheave forms at least one of (i) a first angle of inclination with respect to the axis of rotation of the deflector wheel in a horizontal direction, and (ii) a second angle of inclination with respect to the axis of rotation of the deflector wheel in a vertical direction.

2. The elevator system according to claim 1, including a fixing member on which the traction machine and deflector wheel are mounted, the fixing member having upper and lower surfaces, the upper surface being lower in the elevator shaft than the uppermost extent of the traction machine and the upper edge of the deflector wheel, and the lower surface being higher in the elevator shaft than the lowermost extent of traction machine and the lower edge of the deflector wheel.

3. The elevator system according to claim 2, wherein the elevator shaft has generally parallel side walls and the fixing member is, in the plan view, oblique to the side walls of the elevator shaft.

4. The elevator system according to claim 1, having both the first and second angles of inclination, wherein the first and second angles of inclination are different.

5. The elevator system according to claim 1, having both the first and second angles of inclination, wherein the first and second angles of inclination are the same.

6. The elevator system according to claim 1, wherein the rope is fixed at a first end to a first rope fastener on the counter weight, and at a second end to a second rope fastener on the cage.

7. The elevator system according to claim 1, wherein the rope is fixed at a first end to a first rope fastener in an upper portion of the elevator shaft, and at a second end to a second rope fastener in an upper portion of the elevator shaft, the cage and counter weight have respective suspension wheels, and the cage and counter weight are supported on the rope via their respective suspension wheels.

8. An elevator system comprising:

a cage hoisted in an elevator shaft by a rope;

a counter weight hoisted by the rope;

a traction machine having an uppermost extent and a lowermost extent with respect to vertical movement of the cage in the elevator shaft, located in the elevator shaft at a position higher than a cage stopping position at an uppermost floor of travel of the cage, having a driving sheave rotating around an axis and around which the rope is passed, and a motor for driving the driving sheave to move the cage and counter weight vertically in the elevator shaft; and a deflector wheel rotating about an axis, having an upper edge and a lower edge with respect to vertical movement of the cage in the elevator shaft, around which the rope is passed, the rope extending upward in the elevator shaft, passing around an upper arcuate portion of the deflector wheel, a lower arcuate portion of the driving sheave, and, thereafter, an upper arcuate portion of the driving sheave, and then extending downward in the elevator shaft, wherein the upper edge of the deflector wheel is lower than the uppermost extent of the traction machine in the elevator shaft, the lower edge of the deflector wheel is higher than the lowermost extent of the traction machine in the elevator shaft, and the deflector wheel is spaced from the traction machine in a plan view of the elevator shaft.

9. The elevator system according to claim 8, including a fixing member on which the traction machine and deflector wheel are mounted, the fixing member having upper and lower surfaces, the upper surface being lower in the elevator shaft than the uppermost extent of the traction machine and the upper edge of the deflector wheel, and the lower surface being higher in the elevator shaft than the lowermost extent of traction machine and the lower edge of the deflector wheel.

10. The elevator system according to claim 9, wherein the elevator shaft has generally parallel side walls and the fixing member is, in the plan view, oblique to the side walls of the elevator shaft.

11. The elevator system according to claim 8, wherein the axis of rotation of the driving sheave has at least one of a first angle of inclination with respect to the axis of rotation of the deflector wheel in a horizontal direction, and a second angle of inclination with respect to the axis of rotation of the deflector wheel in a vertical direction.

12. The elevator system according to claim 11, having both the first and second angles of inclination, wherein the first and second angles of inclination are different.

13. The elevator system according to claim 11, having both the first and second angles of inclination, wherein the first and second angles of inclination are the same.

14. The elevator system according to claim 8, wherein the rope is fixed at a first end to a first rope fastener on the counter weight, and at a second end to a second rope fastener on the cage.

15. The elevator system according to claim 8, wherein the rope is fixed at a first end to a first rope fastener in an upper portion of the elevator shaft, and at a second end to a second rope fastener in an upper portion of the elevator shaft, the cage and counter weight have respective suspension wheels, and the cage and counter weight are supported on the rope via their respective suspension wheels.

* * * * *